United States Patent [19]

Carrish

[11] 4,160,257

[45] Jul. 3, 1979

[54] THREE ELECTRODE SYSTEM IN THE GENERATION OF ELECTROSTATIC IMAGES

[75] Inventor: Jeffrey J. Carrish, Hopkinton, Mass.

[73] Assignee: Dennison Manufacturing Company, Framingham, Mass.

[21] Appl. No.: 925,667

[22] Filed: Jul. 17, 1978

[51] Int. Cl.[2] ..... G03G 15/044; H01J 61/06

[52] U.S. Cl. ..... 346/159; 313/207; 315/169.4

[58] Field of Search ..... 346/159, 154; 313/207, 313/217, 220; 315/11.8, 169 TV; 250/426

[56] References Cited

U.S. PATENT DOCUMENTS

| | | | |
|---|---|---|---|
| 3,438,053 | 4/1969 | Howell | 346/154 |
| 3,450,929 | 6/1969 | Dibbern | 313/131 R |
| 3,513,351 | 5/1970 | Kelley | 250/426 |
| 3,569,756 | 3/1971 | Reifenschweiler | 313/207 |
| 3,715,762 | 2/1973 | Magill | 346/159 |
| 3,765,027 | 10/1973 | Bresnick | 346/159 |
| 3,787,876 | 1/1974 | Pressman | 346/154 |
| 4,087,807 | 5/1978 | Miauecz | 315/169 TV |

*Primary Examiner*—Jay P. Lucas

*Attorney, Agent, or Firm*—George E. Kersey

[57] ABSTRACT

Generation of charged particles by extracting them from a high density source provided by an electrical gas breakdown in an electrical field between two conducting electrodes separated by a solid insulator, subject to the influence of a third electrode. The ions are generated by a high frequency alternating potential between a "driver" electrode and a "control" electrode. The ions are employed in charging a dielectric member to form a latent electrostatic charge image. A "screen" electrode between the control electrode and dielectric member isolates the potential on the dielectric member from the ion generating means, and provides an electrostatic lensing action.

16 Claims, 6 Drawing Figures

FIG. 3
(PRIOR ART)
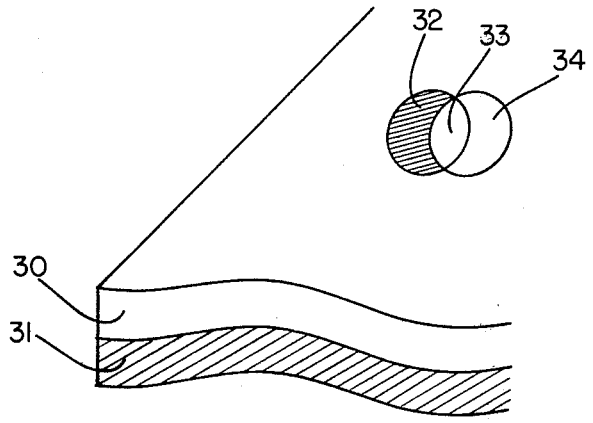
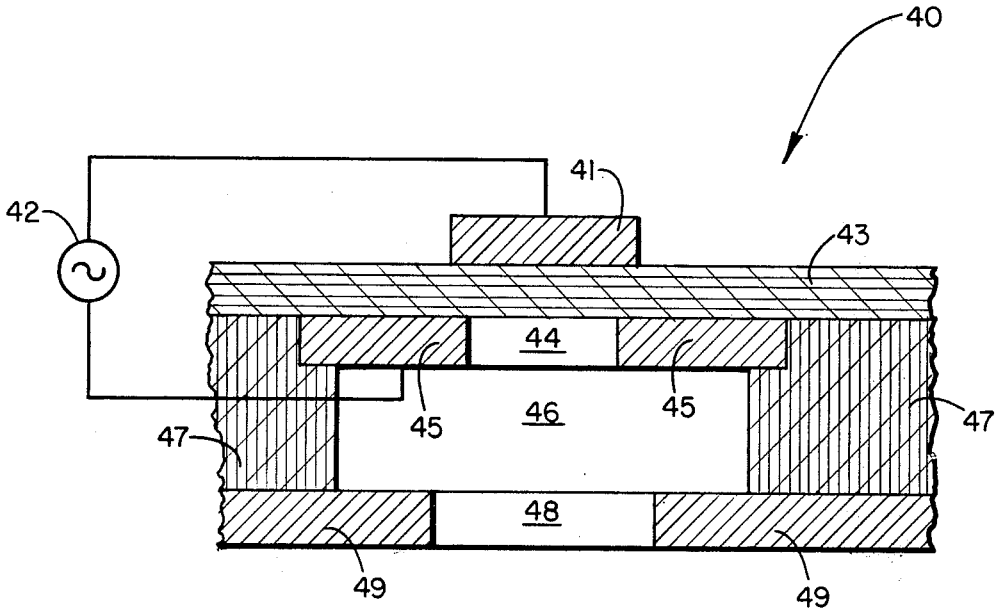
FIG. 4

FIG. 5
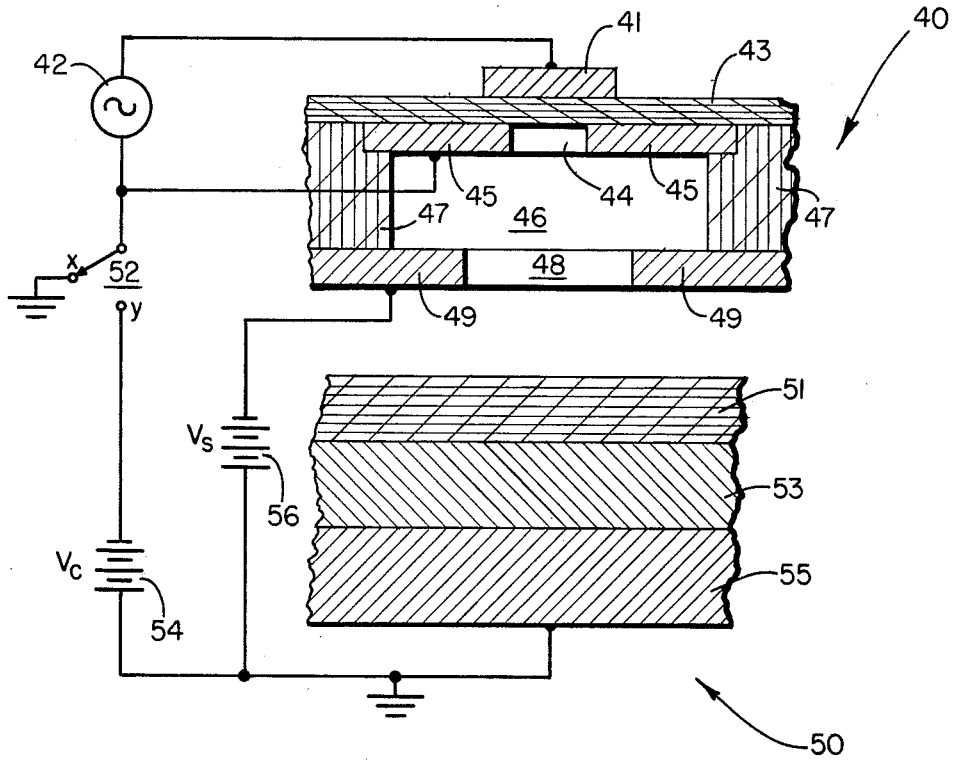
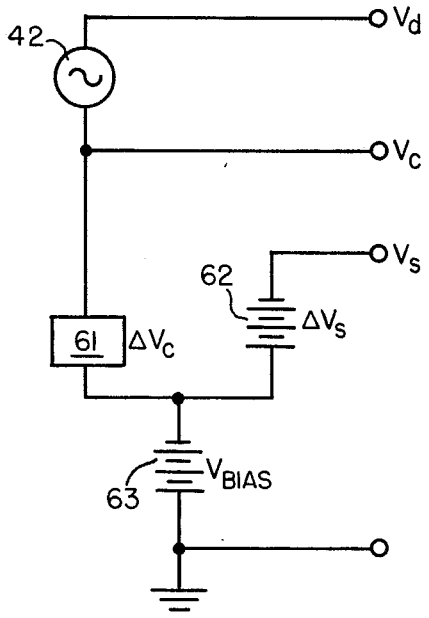
FIG. 6

THREE ELECTRODE SYSTEM IN THE GENERATION OF ELECTROSTATIC IMAGES

BACKGROUND OF THE INVENTION

This invention relates to the generation of charged particles, and more particularly, to the control of electrostatic latent images formed from this charged particle source.

A wide variety of techniques are commonly employed to generate ions in various applications. Conventional techniques include air gap breakdown, corona discharges, spark discharges, and others. The use of air gap breakdown requires close control of gap spacing, and typically results in non-uniform latent charge images. Corona discharges, widely favored in electrostatic copiers, provide limited currents and entail considerable maintenance efforts. Electrical spark discharge methods are unsuitable for applications requiring uniform ion currents. Other methods suffer comparable difficulties.

Apparatus and method for generating ions representing a considerable advance over the above techniques are disclosed in copending application Ser. No. 824,252, filed Aug. 12, 1977. The ion generator of this invention, shown in one embodiment at 10 in FIG. 1, involves the use of two conducting electrodes 12 and 13 separated by a solid insulator 11. When a high frequency electric field is applied between these electrodes by source 14, a pool of negative and positive ions is generated in the areas of proximity of the electrode edges and the dielectric surface. Thus in FIG. 1, an air gap breakdown occurs relative to a region **11-*r* of dielectric 11, creating an ion pool in hole 13-*h*, which is formed in electrode 13**.

These ions may be used, for example, to create an electrostatic latent image on a dielectric member 15 with a conducting backing layer 16. When a switch 18 is switched to position X and is grounded as shown, the electrode 16 is also at ground potential and little or no electric field is present in the region between the ion generator 10 and the dielectric member 15. However, when switch 18 is switched to position Y, the potential of the source 17 is applied to the electrode 13. This provides an electric field between the ion reservoir **11-*r* and the backing of dielectric member 15. Ions of a given polarity (in the generator of FIG. 1, negative ions) are extracted from the air gap breakdown region and charge the surface of the dielectric member 15**.

One advantageous use of this invention, disclosed in the above application, is the formation of characters and symbols in high speed electrographic printing. Apparatus for the formation of dot matrix characters and symbols on dielectric paper or intermediate dielectric members is shown in FIG. 2. A matrix ion generator 20 includes a dielectric sheet 21 with a set of apertured air gap breakdown electrodes 22-1 through 22-4 on one side and a set of selector bars 23-1 through 23-4 on the other side. A separate selector 23 is provided for each different aperture 24 in each finger electrode 22. Ions can only be extracted from an aperture when both its selector bar is energized with a high voltage alternating potential and its finger electrode is energized with a direct current potential applied between the finger electrode and the counterelectrode of the dielectric surface to be charged. Dot matrix characters may be formed using this apparatus by stringing together a series of electrostatic dot images. This is done by moving the dielectric surface to be charged at a prescribed rate past the matrix ion generator 20, and applying direct current pulses to the finger electrodes 22 at a suitable frequency to create a series of overlapping dots.

It has been discovered, however, that this invention suffers a serious disadvantage when utilized in such a dot matrix embodiment, which is illustrated in FIGS. 2 and 3. At an initial time $t_1$, a given aperture $\mathbf{24}_{23}$ on matrix ion generator 20 is energized by a direct current pulse which creates a negative potential on a finger electrode 22-2, while a high frequency potential is applied to selector bar 23-3. This causes the formation of an electrostatic dot image which is negative in polarity, occupying regions 32 and 33 on dielectric surface 30 with backing electrode 31. At a later time $t_2$, aperture $\mathbf{24}_{23}$ is over regions 33 and 34, selector bar 23-3 is still energized, but as charging is not desired, no negative pulse is applied to finger electrode 22-2. The presence of negative electrostatic image in region 33, however, attracts positive ions from the aperture $\mathbf{24}_{23}$, erasing the previously created image in this region.

Accordingly it is a principal object of the invention to provide improved apparatus of the type described above for generating ions. A related object of the invention is the achievement of better control over the charging of dielectric members using such ion generating apparatus.

It is another object of the invention to provide a superior matrix printing apparatus using this ion generating principle. A related object is the avoidance of undesired erasures of electrostatic images.

SUMMARY OF THE INVENTION

In accomplishing the foregoing and related objects, the invention provides for applying a potential between electrodes separated by a solid dielectric member, with a third electrode used to control the discharge of ions thus generated. A high frequency alternating potential is applied between a first, "driver" electrode and a second, "control" electrode, causing an electrical air gap breakdown in fringing field regions. A third, "screen" electrode is separated from the control electrode by a second layer of dielectric. Ions produced by the air gap breakdown can be extracted subject to the influence of the screen electrode and applied to a further member.

In accordance with one aspect of the invention, the applied alternating potential stimulates the generation of a pool of ions of both polarities in a discharge aperture at a junction of the first dielectric member and the control electrode. Ions of one polarity are attracted from this pool to a remote dielectric member if a direct current potential of the same polarity is applied between the control electrode and a conducting layer underlying the remote dielectric member. The screen electrode may be given a lesser constant potential of the same polarity to counteract the tendency of an electrostatic image of this polarity to attract oppositely charged ions from the discharge aperture when the direct current potential is removed between the control electrode and the conducting sublayer.

In accordance with another aspect of the invention, the screen electrode is advantageously included in an ion generator which is intended for applications involving matrix electrographic printing of overlapping images. In a preferred embodiment of the invention, a dot matrix electrographic printer incorporates the screen electrode for the controlled creation of electrostatic images.

BRIEF DESCRIPTION OF THE DRAWINGS

FIG. 3 is a perspective view of a toned electrographic image on a conductor-backed dielectric member, as produced by the matrix ion generator of FIG. 3.

Figure 1:
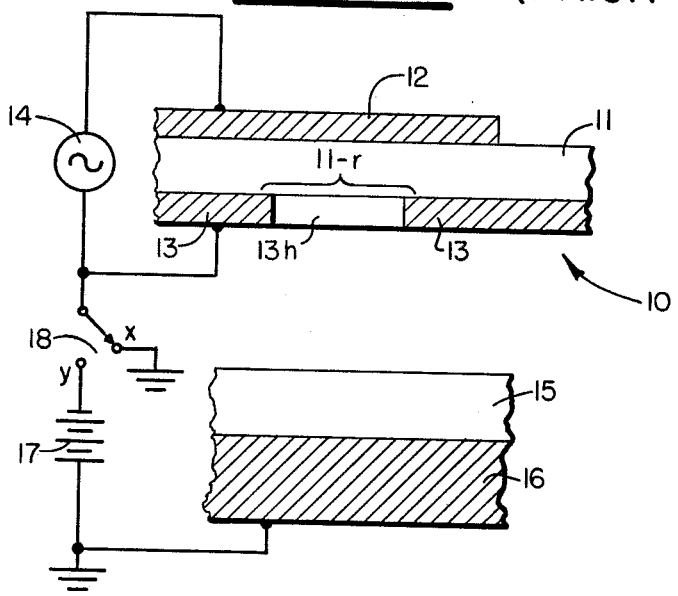
FIG. 1 (PRIOR ART)
FIG. 1 is a schematic and sectional view of a prior art ion generator and extractor.

Various aspects of the invention will become apparent after considering several illustrative embodiments, taken in conjunction with the following:

FIG. 4 is a schematic and sectional view of an ion generator in accordance with the invention.

FIG. 5 is a schematic and sectional view of an ion generator and extractor in accordance with the invention.

FIG. 6 is a schematic view of an alternative circuit to be employed in the ion generator and extractor of FIG. 5.

DETAILED DESCRIPTION

Reference should be had to FIGS. 4–6 for a detailed description of the invention. An ion generator 40 in accordance with the invention is shown in the sectional view of FIG. 4. The ion generator 40 includes a driver electrode 41 and a control electrode 45, separated by a solid dielectric layer 43. A source 42 of alternating potential is used to provide an air gap breakdown in aperture 44.

Figure 2:
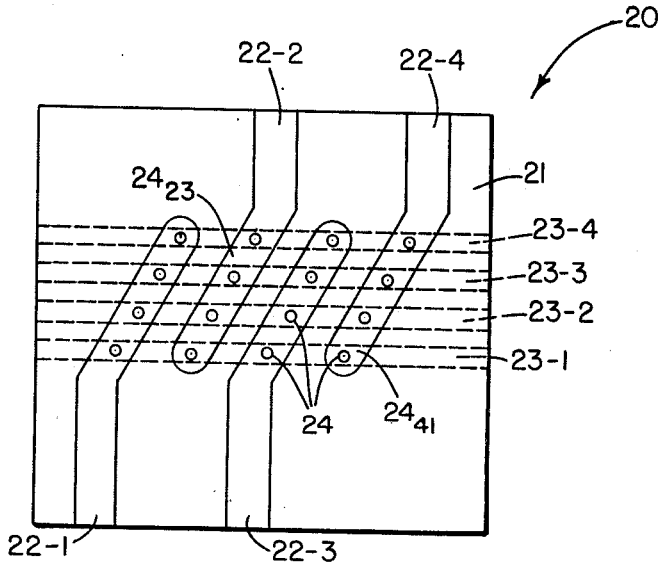
FIG. 2 (PRIOR ART)
FIG. 2 is a plan view of a prior art matrix ion generator.

A third, screen electrode 49 is separated from the control electrode by a second dielectric layer 47. The second dielectric layer 47 has an aperture 46 which advantageously is substantially larger than the aperture 44 in the control electrode. This is necessary to avoid wall charging effects. The screen electrode 49 contains an aperture 48 which is at least partially positioned under the aperture 44. In an electrographic matrix printer, for example, the driver and control electrodes may be the selector bars and finger electrodes of FIG. 2, and the screen electrodes may consist of either additional finger electrodes with apertures matching the pattern of the control electrodes or a continuous apertured metal plate or other member, with its openings adjacent to all printing apertures. The latter embodiment of the screen electrodes may take the form, for example, of an open mesh screen.

The application of the above ion generator in electrographic matrix printing is illustrated in FIG. 5. FIG. 5 shows the ion generator 40 of FIG. 4 used in conjunction with dielectric paper 50 consisting of a conducting base 53 coated with a dielectric layer 51, and backed by a grounded auxiliary electrode 55. When switch 52 is closed at position Y, there is simultaneously an alternating potential across dielectric layer 43, a negative potential $V_C$ on control electrode 45, and a negative potential $V_S$ on screen electrode 49. Negative ions in aperture 44 are subjected to an accelerating field which causes them to form an electrostatic latent image on dielectric surface 51, as in Ser. No. 824,252. The presence of negative potential $V_S$ on screen electrode 49, which is chosen so that $V_S$ is smaller than $V_C$ in absolute value, does not prevent the formation of the image, which will have a negative potential $V_I$ (smaller than $V_C$ in absolute value).

With switch 52 at X, and a previously created electrostatic image of negative potential $V_I$ partially under aperture 44, a partial erasure of the image would occur in the absence of screen electrode 49. Screen potential $V_S$, however, is chosen so that $V_S$ is greater than $V_I$ in absolute value, and the presence of electrode 49 therefore prevents the passage of positive ions from aperture 44 to dielectric surface 41. See Example 1.

The inclusion of screen electrode 49 in the ion generator of the invention confers advantages beyond the prevention of image discharge under the conditions discussed above. The screen electrode may be used alone or in connection with the control electrode to control matrix image formation. With $V_S=0$, no latent image is produced due to the above discharge phenomenon. Thus, three level matrix image control is possible in an electrographic matrix printer in accordance with the invention.

Screen electrode 49 provides unexpected control over image size. Using the dot matrix print configuration shown in FIG. 2 with finger screen electrodes overlaid in accordance with the invention, image size may be controlled by varying the size of screen apertures 48. See Example 2, infra. Furthermore, using such a configuration, with all variables constant except the screen potential 56, a larger screen potential has been found to produce a smaller dot diameter. See Example 3. This technique may be used for the formation of fine or bold images. It has also been found that proper choices of $V_S$ and $V_C$ will allow an increase in the distance between ion generator 40 and dielectric surface 51 while retaining a constant dot image diameter. This is accomplished by increasing the absolute value of $V_S$ while keeping the potential difference between $V_S$ and $V_C$ constant. See Example 4.

Image shape may be controlled by using a given screen electrode overlay in a matrix electrographic printer. See Example 5. Screen apertures 48 may, for example, assume the shape of fully formed characters which are no larger than the corresponding round or square control apertures 44.

The electronic configuration used to control the electrographic printer of FIG. 5 may be modified to allow the possibility of biasing the system, as shown in the circuit schematic of FIG. 6. Element 61 is a pulse generator. The magnitude of the control pulse may be varied to produce a desired $V_C$ and $V_S$ by choosing an appropriate bias potential. For example, the following combinations will all produce $V_S=-700$ volts, $V_C=-800$ volts:

1. $V_{Bias}=-600$ volts; $\Delta V_S=-100$ volts; $\Delta V_C=-200$ volts
2. $V_{Bias}=-500$ volts; $\Delta V_S=-200$ volts; $\Delta V_C=-300$ volts
3. $V_{Bias}=-400$ volts; $\Delta V_S=-300$ volts; $\Delta V_C=-400$ volts
4. $V_{Bias}=-300$ volts; $\Delta V_S=-400$ volts; $\Delta V_C=-500$ volts
5. $V_{Bias}=-200$ volts; $\Delta V_S=-500$ volts; $\Delta V_C=-600$ volts The above advantages are further illustrated with reference to the following non-limiting examples:

EXAMPLE 1

A 1 mil. stainless steel foil is laminated to both sides of a sheet of 0.001 inch thick Kapton® polyimide film. The foil is coated with Resist and photoetched with a pattern similar to that shown in FIG. 2, with holes or apertures approximately 0.006 inches in diameter. A second Kapton® film, 0.006 inch in thickness is bonded to the foil in accordance with FIG. 4. A screen electrode with apertures of 0.015 inch diameter in the same pattern as those of the fingers is photo-etched from 1 mil. stainless steel, and bonded to the second Kapton® film with the finger and screen apertures being concentric. This construction provides a charging head which is used to provide a latent electrostatic image on dielectric paper, as illustrated in FIG. 5, with $V_C = -500$ volts, $V_S = -400$ volts, and an alternating potential 42 of 1 kilovolt peak at a frequency of 500 kilohertz. A spacing of 0.006 inch is maintained between the print head assembly and the dielectric surface 51. $V_C$ takes the form of a print pulse 20 microseconds in duration. Under these conditions, a latent image in the form of a dot of approximately −300 volts is produced on the dielectric sheet. This image is subsequently toned and fused to provide a dense dot matrix character image. The ion current extracted from discharge head as collected by an electrode 0.006 inch away from the head is found to be 0.5 milliampere per square centimeter. With the screen electrode 49 omitted, however, any electrostatic image under the control aperture will be erased when no print pulse is applied.

EXAMPLE 2

The electrographic printer of Example 1 was tested with a variety of diameters for screen aperture 48, and the size of the resulting electrostatic dot image measured. The following results are representative:

| Screen Aperture Diameter (inches) | Dot Image Diameter (inches) |
|---|---|
| .015 | .015 |
| .010 | .012 |
| .008 | .010 |

It was found, in general, that a reduction in the size of the screen apertures caused a corresponding reduction of latent image size, without any compromise in image charge.

EXAMPLE 3

The electrographic printer of Example 1 was tested with a variety of screen potentials, $V_S$, and the size of the resulting electrostatic dot measured. The following results are representative.

| Screen Potential (Volts) | Dot Image Diameter (Inches) |
|---|---|
| −300 | .022 |
| −400 | .017 |
| −500 | .012 |
| −600 | .008 |

It was found, in general, that by increasing the potential on the screen, the latent image size was reduced without any compromise in image charge.

EXAMPLE 4

The electrographic printer of Example 1 was tested using a variety of spacings between the print head assembly and the dialectric surface 51. By varying the screen potential, $V_S$, and holding the potential difference between $V_S$ and $V_C$ constant, the size of the resulting electrostatic dot image was held constant. The following results are representative:

| Separation (inches) | $V_S$ (Volts) | VC (Volts) | Dot Image Diameter (Inches) |
|---|---|---|---|
| .006 | −400 | −500 | .015 |
| .010 | −500 | −600 | .015 |
| .013 | −600 | −700 | .015 |

It was found in general, that with increasing print head assembly to dielectric surface spacing, an increase in screen potential, $V_S$, provides constant dot image diameter without any compromise in image charge.

EXAMPLE 5

The electrographic printer of Example 1 was modified so that the screen had apertures 48 in the form of slots instead of holes. The resulting toned latent electrostatic images were oval in shape.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. An improved method for generating electrostatic images by means of an ion generating assembly of the type in which an alternating potential is applied between a "driver" electrode substantially in contact with one side of a solid dielectric member and a "control" electrode substantially in contact with an opposite side of the solid dielectric member, said control electrode having an edge surface disposed opposite said driver electrode to define an air region at the junction of the edge surface and the solid dielectric member, to induce ion producing electrical discharges in the air region between the solid dielectric member and the edge surface of the control electrode, and ions are extracted by an extraction potential $V_C$ between the control electrode and a further electrode member and these ions applied to a dielectric surface, in which the improvement comprises the steps of controlling the extraction of ions by providing an apertured "screen" electrode which is separated from the control electrode by an apertured solid dielectric member and which lies between the control electrode and the dielectric surface, and applying a "screen" voltage $V_S$ between the screen electrode and the further electrode member, wherein $V_S$ has a magnitude greater than or equal to zero and the same polarity as $V_C$; and forming an electrostatic image with the extracted ions.

2. The method of claim 1 wherein $V_S$ is smaller than $V_C$ in absolute value, whereby the application of screen voltage $V_S$ does not prevent the extraction of ions.

3. The method of claim 2 further comprising the steps of providing a relative motion between the ion generating assembly and the dielectric surface, and regulating the formation of an electrostatic image on the dielectric surface by selective application of extraction voltage $V_C$, said electrostatic image having potential $V_I$ with respect to the further electrode member, wherein the screen voltage $V_S$ is larger in magnitude than the image potential $V_I$ in order to prevent undesired image erasure.

4. The method of claim 1 of the type in which a multiplicity of driver and control electrodes form cross points in a matrix array configured such that the control electrodes contain openings at matrix electrode crossover regions, wherein the controlling step is performed by modulating the extraction of ions from said openings by means of a multiplicity of screen electrodes containing apertures corresponding to said openings.

5. The method of claim 1 further comprising the step of controlling the size of the electrostatic image by providing apertures in said screen electrode of appropriate size.

6. The method of claim 1 further comprising the step of controlling the size of the electrostatic image by providing a screen voltage $V_S$ of appropriate magnitude and polarity.

7. The method of claim 1 further comprising the step of controlling the size of the electrostatic image by providing an appropriate distance between the screen electrode and thhe dielectric surface.

8. The method of claim 1 further comprising the step of controlling the shape of the electrostatic image by providing apertures in said screen electrode of appropriate shape.

9. Improved apparatus for generating electrostatic images of the type including a solid dielectric member, a "driver" electrode substantially in contact with one side of the solid dielectric member, a "control" electrode substantially in contact with an opposite side of the solid dielectric member, with an edge surface of said control electrode disposed opposite said driver electrode to define an air region at the junction of said edge surface and said solid dielectric member means for applying an alternating potential between said driver and control electrode of sufficient magnitude to induce ion producing electrical discharges in said air region between the solid dielectric member and the edge surface of the control electrode, and means for applying an ion extraction potential $V_C$ between the control electrode and a further electrode member to extract ions produced by the electrical discharges in said air region and apply these ions to a dielectric surface to form an electrostatic image thereon, in which the improvement comprises:

a third electrode ("screen electrode");

a solid dielectric layer separating said screen electrode from the control electrode and the solid dielectric member; and a source of "screen" voltage $V_S$ between the screen electrode and the further electrode member, wherein $V_S$ has a magnitude greater than or equal to zero and the same polarity as $V_C$.

10. Apparatus as defined in claim 9 wherein said further electrode member comprises a conductive backing of said dielectric surface.

11. Apparatus as defined in claim 9 wherein the control electrode, screen electrode, and solid dielectric layer contain corresponding discharge apertures.

12. Apparatus as defined in claim 11 wherein the discharge apertures in said solid dielectric layer are larger in diameter than the corresponding discharge apertures in said control electrode.

13. Apparatus as defined in claim 9 wherein the screen voltage $V_S$ is smaller in magnitude than the extraction potential $V_C$, whereby the screen voltage does not prevent the extraction of ions from the air region.

14. Apparatus as defined in claim 13 further comprising means for providing a relative motion between said apparatus for generating electrostatic images and said dielectric surface, and means for modulating said extraction potential $V_C$ in order to selectively form an electrostatic pattern on said dielectric member of voltage $V_I$ with respect to the further electrode member, wherein the screen voltage $V_S$ is larger in magnitude than the ion extraction potential $V_I$ in order to prevent undesired image erasure.

15. Apparatus as defined in claim 9 of the type in which a multiplicity of driver and control electrodes form cross points in a matrix array configured such that the control electrodes contain openings at matrix electrode crossover regions, wherein said solid dielectric layer contains apertures corresponding to said openings, and said screen electrode comprises a multiciplicity of electrodes matching the control electrodes and containing apertures corresponding to said openings.

16. Apparatus as defined in claim 9 of the type in which a multiplicity of driver and control electrodes form cross points in a matrix array configured such that the control electrodes contain openings at matrix crossover regions, wherein said solid dielectric layer contains apertures corresponding to said openings, and said screen electrode comprises a conducting member containing a series of apertures corresponding to said openings.

* * * * *

UNITED STATES PATENT OFFICE
CERTIFICATE OF CORRECTION

Patent No. 4,160,257 Dated July 3, 1979

Inventor(s) Jeffrey J. Carrish

It is certified that error appears in the above-identified patent and that said Letters Patent are hereby corrected as shown below:

Column 7, line 25, "thhe" should read --- the ---.

Column 7, line 40, after "member" to read --- , ---.

Signed and Sealed this

*Fifteenth* Day of *July 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,160,257

DATED : Jul. 3, 1979

INVENTOR(S) : Jeffrey J. Carrish

It is certified that error appears in the above—identified patent and that said Letters Patent is hereby corrected as shown below:

Column 8, line 32, after "the" cancel "ion extraction" and substitite --image--.

Signed and Sealed this

*Seventeenth* Day of *March 1981*

[SEAL]

*Attest:*

RENE D. TEGTMEYER

*Attesting Officer*

*Acting Commissioner of Patents and Trademarks*